US011306509B2

(12) United States Patent
Cai

(10) Patent No.: US 11,306,509 B2
(45) Date of Patent: Apr. 19, 2022

(54) BOTTOM OPENING PASSWORD LOCK

(71) Applicant: NINGBO JIANGBEI RUIFENG LOCK INDUSTRY CO., LTD., Ningbo (CN)

(72) Inventor: Zhihui Cai, Ningbo (CN)

( * ) Notice: Subject to any disclaimer, the term of this patent is extended or adjusted under 35 U.S.C. 154(b) by 16 days.

(21) Appl. No.: 16/721,722

(22) Filed: Dec. 19, 2019

(65) Prior Publication Data

US 2020/0199908 A1 Jun. 25, 2020

(30) Foreign Application Priority Data

Dec. 24, 2018 (CN) ..... 201822170972.1

(51) Int. Cl.

| | |
|---|---|
| ***E05B 37/02*** | (2006.01) |
| ***E05B 37/00*** | (2006.01) |
| ***E05B 15/00*** | (2006.01) |
| ***E05B 15/04*** | (2006.01) |

(52) U.S. Cl.

CPC ..... *E05B 37/025* (2013.01); *E05B 15/0086* (2013.01); *E05B 15/04* (2013.01); *E05B 37/0058* (2013.01); *E05B 37/0068* (2013.01)

(58) Field of Classification Search

CPC .. E05B 15/0086; E05B 15/04; E05B 37/0048; E05B 37/0058; E05B 37/0068; E05B 37/02; E05B 37/025

See application file for complete search history.

(56) References Cited

U.S. PATENT DOCUMENTS 1,964,936 A * 7/1934 Denerich ..... E05B 37/025 70/25
2,853,868 A * 9/1958 Vahlstrom ..... E05B 37/025 70/24
3,983,724 A * 10/1976 Foote ..... E05B 37/025 70/25
4,047,406 A * 9/1977 Foote ..... E05B 37/025 70/25
4,111,014 A * 9/1978 Epstein ..... E05B 37/025 70/25
4,531,388 A * 7/1985 Garro ..... E05B 37/025 70/25

(Continued)

*Primary Examiner* — Christopher J Boswell
(74) *Attorney, Agent, or Firm* — Prakash Nama; Global IP Services, PLLC

(57) ABSTRACT

A bottom opening password lock comprises a lock case and a liner arranged in the lock case as well as a shackle connected with a top of the lock case, and a fork, a password assembly and a locking mechanism are installed and arranged on the liner; the password assembly comprises a pin shaft and a second spring, a clutch sleeve, a password wheel, a code adjusting lever and a washer sleeved on the pin shaft. One end of the second spring is abutted against an inner side of the washer, and the other end is abutted against the clutch sleeve away from the code adjusting lever. The bottom opening of the present invention adjusts a password through the code adjusting lever, the code adjusting lever is toggled manually, the code adjusting lever directly pushes the clutch sleeve to move and separate from the password wheel, and the pin shaft is motionless. The code adjusting lever is located at the bottom of a lock body, which is convenient to adjust, may not be lost, and is more convenient for users to use.

8 Claims, 4 Drawing Sheets

(56) References Cited

U.S. PATENT DOCUMENTS

| | | | | | |
|---|---|---|---|---|---|
| 4,887,441 | A * | 12/1989 | Ling | ..... | E05B 37/025 70/25 |
| 6,012,309 | A * | 1/2000 | Liu | ..... | E05B 37/025 70/25 |
| 7,536,883 | B1 * | 5/2009 | Liu | ..... | E05B 37/025 70/25 |
| 8,769,999 | B2 * | 7/2014 | Nave | ..... | E05B 37/025 70/25 |

* cited by examiner

BOTTOM OPENING PASSWORD LOCK

RELATED APPLICATIONS

This application is a Non-provisional Application under 35 USC 111(a), which claims Chinese Patent Application No. 201822170972.1, filed Dec. 24, 2018, the disclosure of all of which are hereby incorporated by reference in their entirety.

TECHNICAL FIELD

The present invention relates to a bottom opening password lock.

BACKGROUND

Compared with a traditional padlock, a password padlock does not use a key to unlock, thus increasing the ease of use, and also increasing the security of locks.

However, the existing password padlock also has the following defects in a practical application:

1. When a password is set, a key is needed to be inserted, the key pushes a pin, and a ring washer on the pin pushes a clutch sleeve. The key is easy to be lost, and after the key is lost, it is unable to reset a password.

2. There are many kinds of parts, and after the parts are assembled, the ring washer is also clamped to stop, and the assembly is more difficult.

3. The bottom cover and a zinc alloy base are closely clamped through three convex points, there are many processing procedures, it is more difficult to install, and under the strong vibration circumstances, the bottom cover is easy to drop.

SUMMARY

The present invention provides a bottom opening password lock which has few kinds of parts and simple assembly.

A technical solution adopted to solve the technical problems by the present invention is as follows:

A bottom opening password lock comprises a lock case and a liner arranged in the lock case as well as a shackle connected with a top of the lock case, and a fork, a password assembly and a locking mechanism are installed and arranged on the liner; the password assembly comprises a pin shaft and a second spring, a clutch sleeve, a password wheel, a code adjusting lever and a washer sleeved on the pin shaft, and one end of the second spring is abutted against an inner side of the washer, and the other end is abutted against the clutch sleeve away from the code adjusting lever; and the clutch sleeve comprises a shaft sleeve and a driving part. The password wheel is sleeved on the shaft sleeve. Multiple notches are arranged in the center of the password wheel. A convex key that extends towards one side of the shaft sleeve and is matched with the notch is arranged on the driving part. The code adjusting lever comprises a sleeving portion and a handle. The sleeving portion is sleeved on the pin shaft. An opening for the handle to extend is arranged at the bottom of the lock case.

Preferably, the opening is L-shaped.

Preferably, the driving part comprises a flat portion and a curved portion, a groove is arranged on the curved portion, and a bulge that is matched with the groove is arranged on the liner.

Preferably, a first spring is also arranged on the liner; and one end of the first spring is connected with the fork, and the other is connected with the liner.

Preferably, a curved bulge is arranged on the flat portion, and a curved recess that is matched with the curved bulge is arranged on the end of a leg.

Preferably, the number of the clutch sleeve and the password wheel is respectively four.

Preferably, the shackle is a U-bar, and a clamping groove is arranged in an inner side of the opposite bar.

Preferably, the fork comprises the leg that is matched with the password assembly and a stop end that is matched with the locking mechanism.

Preferably, the locking mechanism comprises a left bolt, a right bolt and a third spring arranged between the left bolt and the right bolt.

Compared with the prior art, the bottom opening of the present invention adjusts a password through the code adjusting lever, the code adjusting lever is toggled manually, the code adjusting lever directly pushes the clutch sleeve to move and separate from the password wheel, and the pin shaft is motionless. The code adjusting lever is located at the bottom of a lock body, which is convenient to adjust, may not be lost, and is more convenient for users to use.

The bottom opening password lock does not need a key, a copper ring and ring washer parts; and the specification of the clutch sleeve is changed from at least two kinds to one kind, so that it is very convenient to install. First, the password wheel, the clutch sleeve, the code adjusting lever and the second spring can be put away, and then the pin shaft is directly inserted.

The bottom opening password lock removes three convex points on a bottom cover and a zinc alloy base. A through hole is added on the bottom cover, and the bottom cover is connected with the base through the pin shaft, so that it is convenient to install, and a dropping phenomenon under the vibration circumstance is also solved, thereby greatly increasing the reliability and security of the lock, reducing the difficulty in manufacturing a base mold, reducing the processing procedure of the bottom cover, and reducing the production cost.

DETAILED DESCRIPTION

Figure 1:
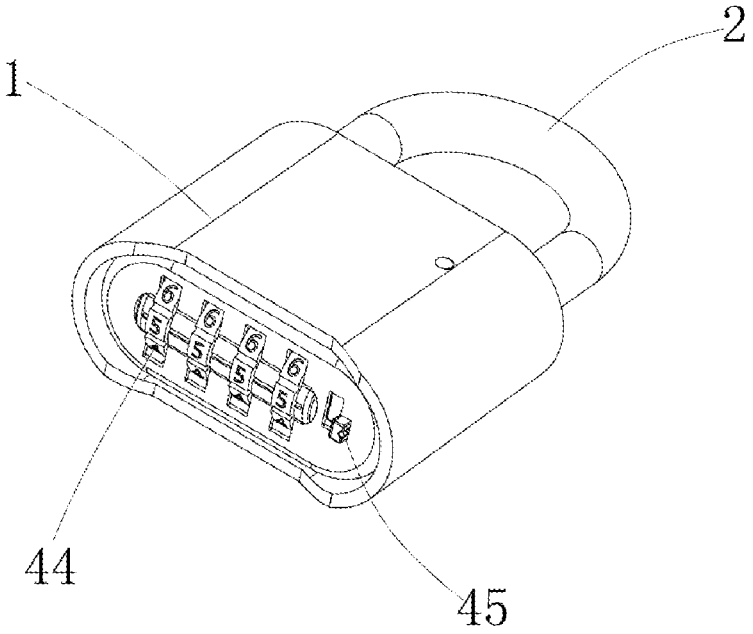
FIG. 1 is a stereographic schematic diagram of a bottom opening password lock of the present invention.
Figure 2:
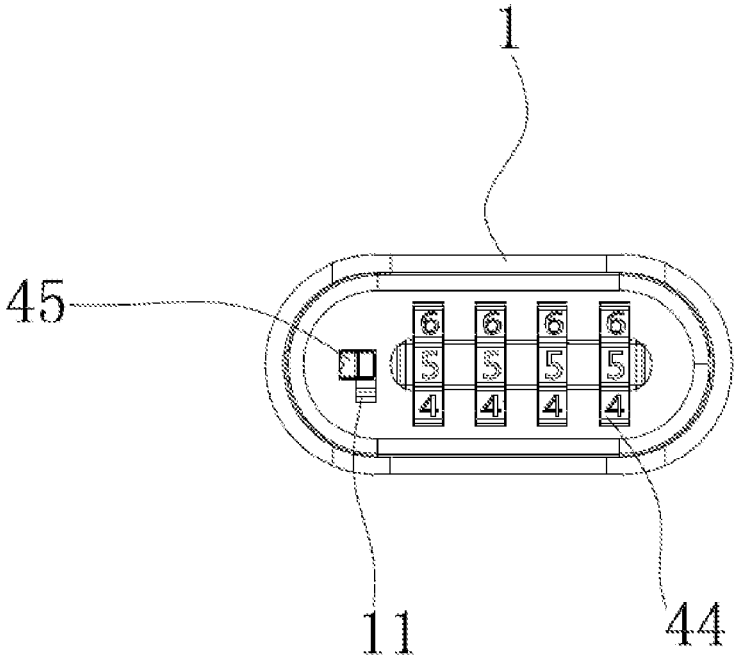
FIG. 2 is a lock state schematic diagram of a bottom opening password lock of the present invention.

The present invention is further described below in detail in combination with the drawings and embodiments.

As shown in FIG. 1 to FIG. 7, a bottom opening password lock comprises a lock case 1 and a liner 7 arranged in the lock case 1 as well as a shackle 2 connected with a top of the lock case 1. The shackle 2 is a U-bar, and a clamping groove 21 is arranged in an inner side of the opposite bar, and a fork 3, a password assembly 4, a locking mechanism 5 and a first spring 6 are arranged on a liner 7; one end of the first spring 6 is connected with the fork 3, and the other of the first spring 6 is connected with the liner 7; and a fourth spring 8 is sleeved at the root of the shackle 2.

The fork 3 comprises the leg 31 that is matched with the password assembly 4 and a stop end 32 that is matched with the locking mechanism 5.

The password assembly 4 comprises a pin shaft 41 and a second spring 42, a clutch sleeve 43, a password wheel 44, a code adjusting lever 45 and a washer 46 sleeved on the pin shaft 41. The number of the clutch sleeve 43 and the password wheel 44 is respectively four. The second spring 42 is sleeved on the pin shaft 41 and one end is abutted against an inner side of the washer 46, and the other end is abutted against the clutch sleeve 43 away from the code adjusting lever 45. The clutch sleeve 43 comprises a shaft sleeve 431 and a driving part 432. The password wheel 44 is sleeved on the shaft sleeve 431, and the shaft sleeve 431 is sleeved on the pin shaft 41. The driving part 432 comprises a flat portion 4321 and a curved portion 4322, a groove 4323 is arranged on the curved portion 4322, and a bulge 71 that is matched with the groove 4323 is arranged on the liner 7. Multiple notches 441 are arranged in the center of the password wheel 44. A convex key 4324 that extends towards one side of the shaft sleeve 431 is arranged on the driving part. When the convex key 4324 is matched with the notch 441 of the password wheel 44, stirring the password wheel 44 can drive the clutch sleeve 43 to rotate. a curved bulge 4325 is arranged on a flat portion 4321, and the curved bulge 4325 is arranged in the middle of the flat portion 4321; and a curved recess (not shown in Figure) that is matched with the curved recess 4325 is arranged on an end of a leg 31, therefore, the matching of the leg 31 with the clutch sleeve 43 is more tightened, and the working performance is more reliable.

The code adjusting lever 45 comprises a sleeving portion 451 and a handle 452, the sleeving portion 451 is sleeved on the pin shaft 41 and an L-shaped opening 11 for the handle 452 to extend is arranged at the bottom of the lock case 1.

The locking mechanism 5 comprises a left bolt 51, a right bolt 53 and a third spring 52 arranged between the left bolt 51 and the right bolt 53.

When the password lock is in a lock state, as long as any password of the password wheel 44 is not correct, the leg 31 of the fork 3 will be in contact with the curved portion of the clutch sleeve 43, therefore, the leg 31 will be jacked up, the stop end 32 of the fork 3 is clamped between the left bolt 51 and the right bolt 53, and the ends of the left bolt 51 and the right bolt 53 are matched with the clamping groove 21, thereby realizing the lock of the password lock. The stop end 32 of the fork 3 is clamped between the left bolt 51 and the right bolt 53, which can prevent the left bolt 51 and the right bolt 53 from separating from the clamping groove 21.

When the password lock is in an unlock state, when four numbers of the password wheel 44 is toggled to a set password, under the acting force of the first spring 6, the flat portions 4321 of four clutch sleeves 43 are fitted with the leg, therefore, the stop end 32 of the fork 3 is separated from a position between the left bolt 51 and the right bolt 53, and the shackle 2 is manually pulled, to cause the left bolt 51 and the right bolt 53 to separate from the clamping groove 21, so that the unlock of the shackle 2 can be realized.

Figure 3:
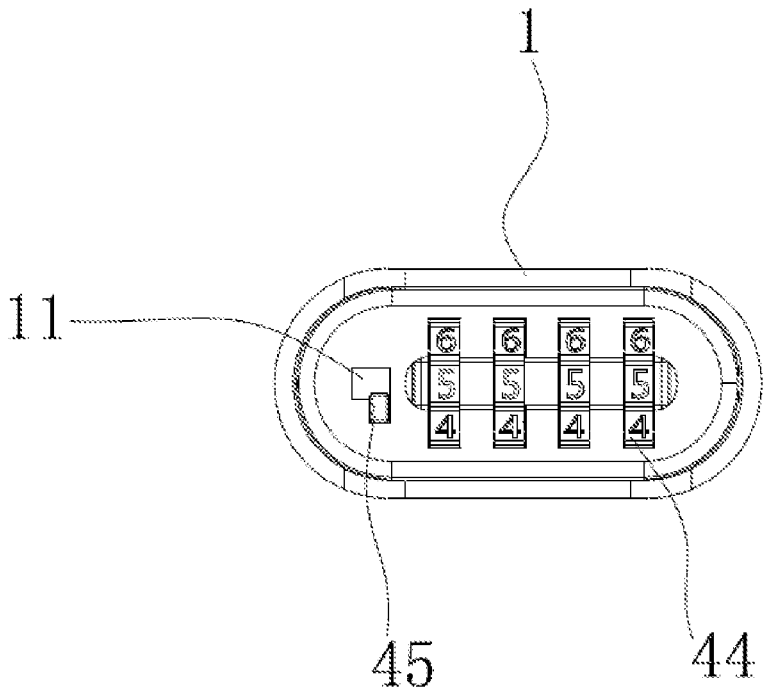
FIG. 3 is a code-adjusting state schematic diagram of a bottom opening password lock of the present invention.
Figure 4:
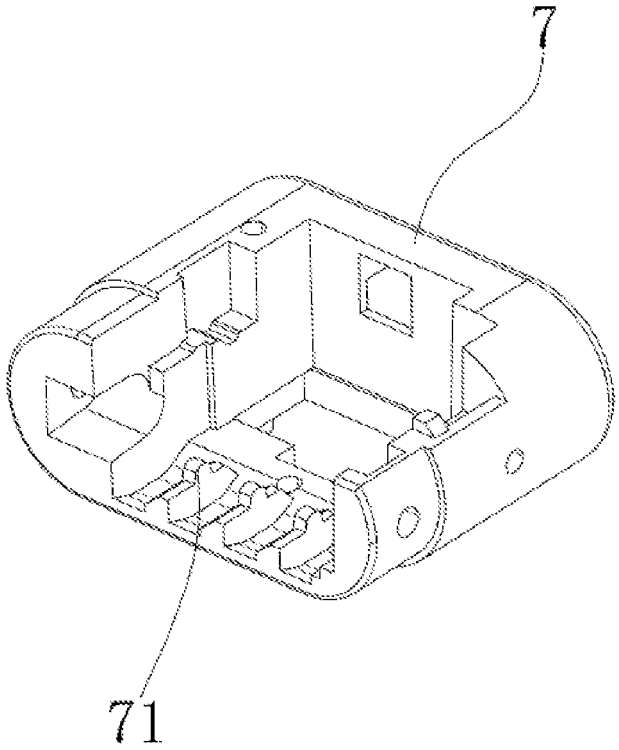
FIG. 4 is a stereographic schematic diagram of a liner of a bottom opening password lock of the present invention.
Figure 5:
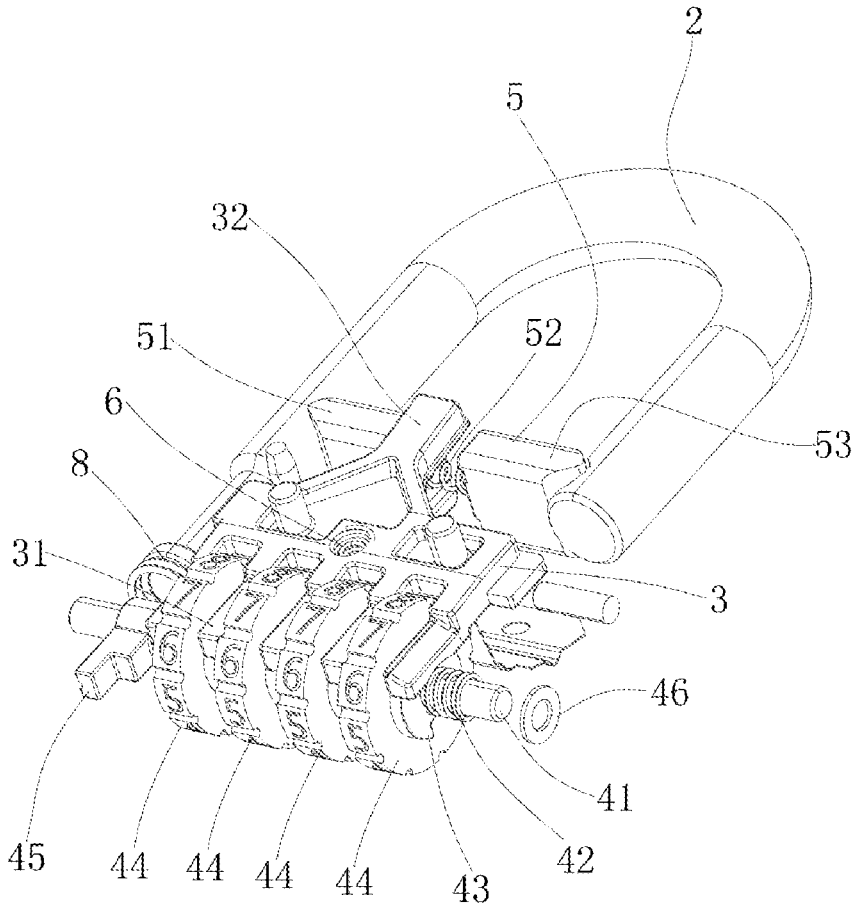
FIG. 5 is a local schematic diagram of a bottom opening password lock of the present invention.
Figure 6:
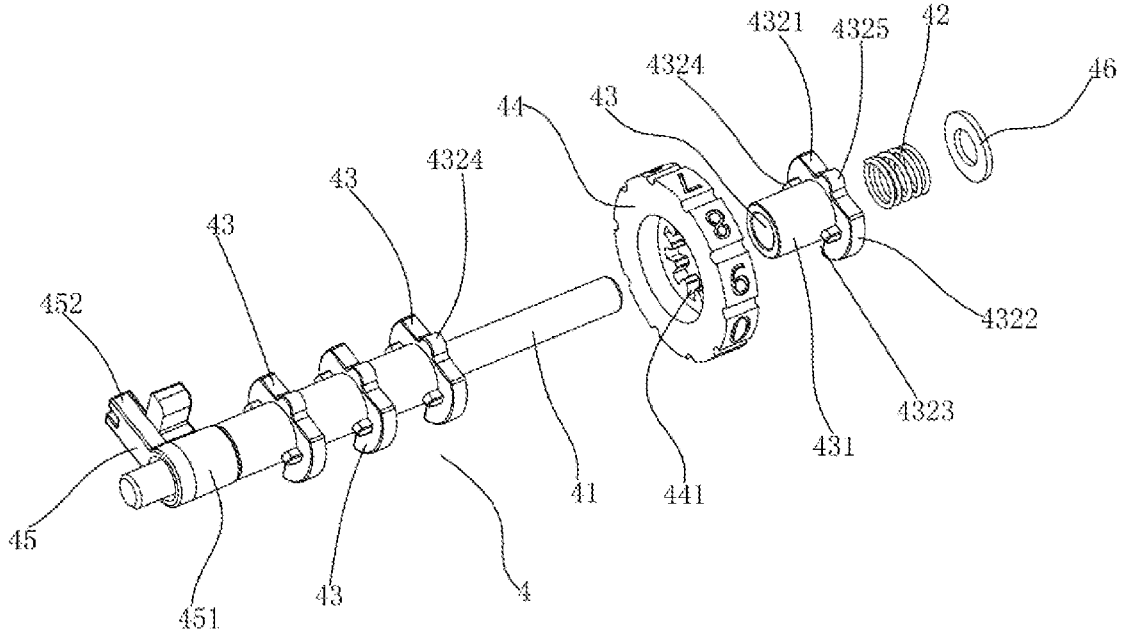
FIG. 6 is an exploded schematic diagram of a password assembly of a bottom opening password lock of the present invention.
Figure 7:
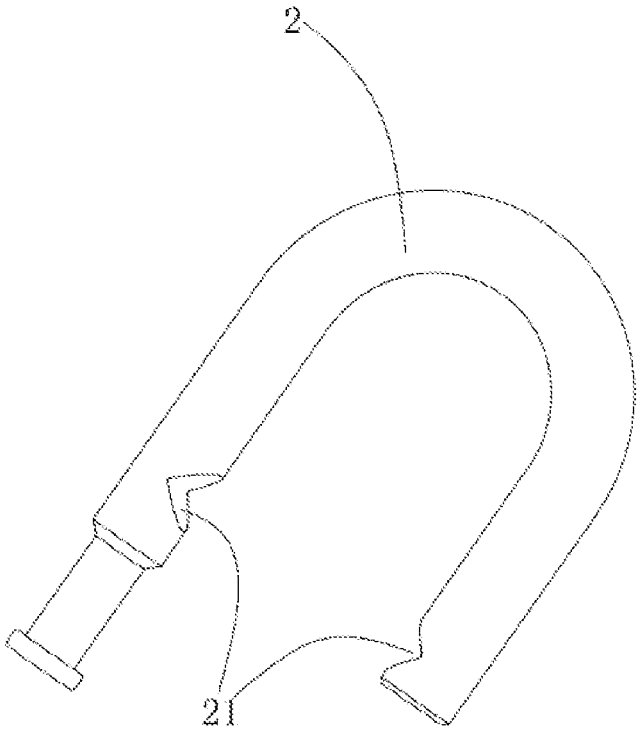
FIG. 7 is a shackle schematic diagram of a password assembly of a bottom opening password lock of the present invention.

When the password needs to be reset and the code adjusting lever 45 is toggled to a position shown in FIG. 3, the code adjusting lever 45 moves to the right, so that the convex keys 4324 of four clutch sleeves 43 are separated from the notches 441 of the password wheel 44, and the groove 4323 of the clutch sleeve 43 is matched with the bulge 71 arranged on the liner 7. The clutch sleeve 43 can not rotate around the pin shaft 41. Since the password wheel 44 is separated from the convex keys 4324 of the clutch sleeve 43, the password wheel 44 can rotate around the clutch sleeve 43, so that the passwords of four password wheels 44 can be reset. After the password is reset, the code adjusting lever 45 is toggled to a position shown in FIG. 2 and is reset.

When the password is correct, the flat portions 4321 of four clutch sleeves 43 are in the same plane and is fitted with a surface of the leg 31 of the fork 3, and at this moment, the stop end 32 of the fork 3 is separated from the position between the left bolt 51 and the right bolt 53, and the fourth spring 8 is forced to push the shackle 2 to eject and unlock. At this moment, the clutch sleeve 43 can be pushed to separate from the password wheel 44, the password wheel 44 is rotated to set a new password, after the setting is completed, and under the acting force of the second spring 42, the clutch sleeve 43 and the password wheel 44 are matched and reset.

When the password is incorrect, at least one of flat portions 4321 of four clutch sleeves is not in the same plane and is not fitted with the surface of the leg 31 of the fork 3, and at this moment, the stop end 32 of the fork 3 enters the left bolt 51 and the right bolt 53 to block out, and the left bolt 51 and the right bolt 53 locks the shackle 2, so that the shackle 2 can not be removed from the lock case 1, thereby realizing locking.

The bottom opening of the present invention adjusts a password through the code adjusting lever 45, the code adjusting lever 45 is toggled manually, the code adjusting lever 45 directly pushes the clutch sleeve 43 to move and separate from the password wheel 44, and the pin shaft 41 is motionless. The code adjusting lever 45 is located at the bottom of a lock body, which is convenient to adjust, may not be lost, and is more convenient for users to use.

The bottom opening password lock does not need a key, a copper ring and ring washer parts; and the specification of the clutch sleeve 43 is changed from at least two kinds to one kind, so that it is very convenient to install. First, the password wheel 44, the clutch sleeve 43, the code adjusting lever 45 and the second spring 42 can be put, and then the pin shaft 41 is directly inserted.

The bottom opening password lock removes three convex points on a bottom cover and a zinc alloy base. A through hole is added on the bottom cover, and the bottom cover is connected with the base through the pin shaft 41, so that it is convenient to install, and a dropping phenomenon under the vibration circumstance is also solved, thereby greatly increasing the reliability and security of the lock, reducing the difficulty in manufacturing a base mold, reducing the processing procedure of the bottom cover, and reducing the production cost.

Finally, it should be noted that the above embodiments are only used for describing the technical solution of the present invention rather than limitation. Although the present invention is described in detail by referring to the above embodiments, those ordinary skilled in the art should understand that: the technical solution recorded in each of the above embodiments can be still amended, or some technical features therein can be replaced equivalently. However, these amendments or replacements do not enable the essence of the corresponding technical solution to depart from the spirit and the scope of the technical solution of various embodiments of the present invention.

The invention claimed is:

1. A bottom opening password lock, comprising a lock case (1) and a liner (7) arranged in the lock case (1) as well as a shackle (2) connected with a top of the lock case (1), and wherein a fork (3), a password assembly (4) and a locking mechanism (5) are installed and arranged on the liner (7); and characterized in that the password assembly (4) comprises a pin shaft (41) and a second spring (42), a clutch sleeve (43), a password wheel (44), a code adjusting lever (45) and a washer (46) sleeved on the pin shaft (41), and one end of the second spring (42) is abutted against an inner side of the washer (46), and the other end is abutted against the clutch sleeve (43) away from the code adjusting lever (46); and the clutch sleeve (43) comprises a shaft sleeve (431) and a driving part (432); the password wheel (44) is sleeved on the shaft sleeve (431); multiple notches (441) are arranged in the center of the password wheel (44); a convex key (4324) that extends towards one side of the shaft sleeve (431) along a longitudinal direction of an axis of the pin shaft (41) and is matched with the notch (441) is arranged on the driving part (432); the code adjusting lever (45) comprises a sleeving portion (451) and a handle (452); The sleeving portion (451) is sleeved on the pin shaft (41); an opening (11) for the handle (452) to extend is arranged at the bottom of the lock case (1); the driving part (432) comprises a flat portion (4321) and a curved portion (4322), a groove (4323) is arranged on the curved portion (4322), and a bulge (71) that is matched with the groove (4323) is arranged on the liner (7); when adjusting a password through the code adjusting lever (45), the code adjusting lever (45) directly pushes the clutch sleeve (43) to move and separate from the password wheel (44) while the pin shaft (41) is motionless so that the convex key (4324) is separated from the notch (441) of the password wheel (44), and the groove (4323) of the clutch sleeve (43) is matched with the bulge (71) arranged on the liner (7) so that the clutch sleeve (43) does not rotate around the pin shaft (41).

2. The bottom opening password lock according to claim 1, characterized in that the opening (11) is L-shaped.

3. The bottom opening password lock according to claim 1, characterized in that a first spring (6) is also arranged on the liner (7); and one end of the first spring (6) is connected with the fork (3), and the other is connected with the liner (7).

4. The bottom opening password lock according to claim 1, characterized in that a number of the clutch sleeve (43) and the password wheel (44) is respectively four.

5. The bottom opening password lock according to claim 1, characterized in that a curved bulge (4325) is arranged on the flat portion (4321), and a curved recess that is matched with the curved bulge (4325) is arranged on the end of a leg (31).

6. The bottom opening password lock according to claim 1, characterized in that the shackle (2) is a U-bar, and a clamping groove (21) is arranged in an inner side of the opposite bar.

7. The bottom opening password lock according to claim 1, characterized in that the fork (3) comprises the leg (31) that is matched with the password assembly (4) and a stop end (32) that is matched with the locking mechanism (5).

8. The bottom opening password lock according to claim 1, characterized in that the locking mechanism (5) comprises a left bolt (51), a right bolt (53) and a third spring (52) arranged between the left bolt (51) and the right bolt (53).

* * * * *